US007648298B2

(12) United States Patent
Gueret

(10) Patent No.: US 7,648,298 B2
(45) Date of Patent: Jan. 19, 2010

(54) PACKAGING AND APPLICATOR DEVICE COMPRISING A SUPPORT AND A DISTRIBUTION MEMBER, AND A METHOD OF APPLYING A PRODUCT WITH SUCH A DEVICE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 537 days.

(21) Appl. No.: 11/115,194

(22) Filed: Apr. 27, 2005

(65) Prior Publication Data

US 2005/0249540 A1 Nov. 10, 2005

Related U.S. Application Data

(60) Provisional application No. 60/572,111, filed on May 19, 2004.

(30) Foreign Application Priority Data

Apr. 28, 2004 (FR) ..... 04 50819

(51) Int. Cl.
*B43K 7/10* (2006.01)

(52) U.S. Cl. ..... 401/211

(58) Field of Classification Search ..... 401/196, 401/197, 208, 209, 211
See application file for complete search history.

(56) References Cited

U.S. PATENT DOCUMENTS

| | | | | |
|---|---|---|---|---|
| 2,029,056 | A * | 1/1936 | Carlson | 401/208 |
| 2,940,106 | A * | 6/1960 | Hopkins | 401/100 |
| 4,764,046 | A * | 8/1988 | Kitamura et al. | 401/270 |
| 4,940,350 | A * | 7/1990 | Kim | 401/209 |
| 5,401,113 | A | 3/1995 | Gueret | |
| 5,836,320 | A | 11/1998 | Gueret | |
| 2003/0072602 | A1 | 4/2003 | Gueret | |

FOREIGN PATENT DOCUMENTS

| | | |
|---|---|---|
| EP | 1 043 018 A1 | 10/2000 |
| EP | 1 314 373 A2 | 5/2003 |

* cited by examiner

*Primary Examiner*—Huyen Le
(74) *Attorney, Agent, or Firm*—Oliff & Berridge, PLC.

(57) ABSTRACT

A device for packaging and applying a product may include: a receptacle containing the product; a support that defines a housing configured to pass the product emanating from the receptacle and includes dispersed magnetic particles; and an applicator member retained in the housing.

32 Claims, 3 Drawing Sheets

PACKAGING AND APPLICATOR DEVICE COMPRISING A SUPPORT AND A DISTRIBUTION MEMBER, AND A METHOD OF APPLYING A PRODUCT WITH SUCH A DEVICE

CROSS-REFERENCE TO RELATED APPLICATIONS

This non-provisional application claims the benefit of French Application No. 04 50819 filed on Apr. 28, 2004, and U.S. Provisional Application No. 60/572,111 filed on May 19, 2004.

BACKGROUND

The present invention relates to devices for packaging and applying a cosmetic product, for example, a makeup or a care product.

The term "cosmetic product" as used in the context of the present invention means a product as defined in Council Directive 93/35/EEC of Jun. 14, 1993, that amends Council Directive 76/768/EEC.

European patent application EP-A2-1 314 373 describes a device for packaging and applying a product, the device comprising a ball that is rotatably mounted in a housing, the ball including at least one substance that is capable of exerting an action on the product. In particular, the product may be exposed to a magnetic field generated by the ball during application. Such exposure may, for example, be intended to endow the product, after the product has been packaged, with properties that the product does not possess at the time the product is packaged.

SUMMARY

There exists a need for a device that, for example, may enhance an intensity of a magnetic field to which a product and/or a treated surface is exposed.

There is also a need to generate a magnetic field in another manner.

The invention aims to satisfy some or all of such needs.

Exemplary embodiments of the invention provide a device for packaging and applying a product, comprising: a receptacle containing the product; a support defining a housing to pass product emanating from the receptacle; and an applicator member retained in the housing; the support including dispersed magnetic particles.

In exemplary embodiments, the support may, for example, comprise a part that is molded as a single piece with the dispersed magnetic particles. The support may also comprise a sintered material.

The expression "magnetic particles" should be construed in its widest sense and encompasses particles that are magnetizable and particles that are magnetized.

The magnetic particles may, for example, be ferrites or other magnetic oxides.

In exemplary embodiments, the applicator member is not rotatable in the housing.

In other exemplary embodiments, the applicator member may be rotatably movable in the housing, for example, about a point, such as a center of symmetry. In exemplary embodiments, the applicator member may be rotatably movable about an axis of rotation in the housing. The axis of rotation may, for example, be perpendicular to a longitudinal axis of the device.

In exemplary embodiments, the applicator member may have a number of different forms, such as, for example, a substantially spherical, cylindrical, ovoid, discoid, annular, or groundnut-shaped form. If necessary or desired, the applicator member may comprise a body of revolution. The outer surface of the applicator member may or may not be smooth, may or may not be flocked, and may have a surface appearance that may or may not be entirely uniform.

In exemplary embodiments, the product may flow in a space formed between the applicator member and the support with a magnetic field existing in the space.

In exemplary embodiments, the applicator member may include at least one cavity that is visible to the naked eye. Such a cavity may serve, for example, to increase an area of exchange with the product, to provide a reserve of product, and/or to facilitate passing through the housing containing the applicator member. The applicator member may include at least one vane. The cavity or cavities of the applicator member may be made in a variety of manners. At least one cavity may be a through cavity, or may be blind. The applicator member may thus include at least one through passage, if appropriate or desired.

In exemplary embodiments, the at least one cavity may be in the form of a crater or a space formed between ribs or vanes, or may be defined by a V-groove or any surface that is not entirely convex.

In exemplary embodiments, dimensions of the applicator member may be selected as a function of dimensions of the receptacle, a nature of the product, and/or a nature of a region to be treated. A largest dimension of the applicator member may, for example, be in a range of about 5 mm (millimeters) to about 65 mm. For example, the largest dimension may be in a range of about 7 mm to about 50 mm, limits included.

In exemplary embodiments, the applicator member may be substantially non-deformable during application. In exemplary embodiments, the applicator member may be arranged so as to deform on application, for example, by being made out of a material that allows deformation on application, such as, for example, an elastically deformable material.

In exemplary embodiments, the support may be made, at least in part, out of a material that is more flexible than a material out of which the applicator member is made. This may, for example, allow the applicator member to be displaced relative to the receptacle on application to obtain a feeling of softness on application.

In exemplary embodiments, the device may include a transfer member that transfers product to the applicator member. The transfer member may be rotatable.

In exemplary embodiments, the support may or may not be removably fixed to the receptacle. The support may, for example, be fixed on a rod of a pump provided in the receptacle. The support may also be snap-fastened on the receptacle. The support may also be made as a single piece with the receptacle. The support and the receptacle may, for example, comprise a single molding.

In exemplary embodiments, the support may be made out of a plastics material, for example, by injection molding. The plastics material of the support may comprise a thermoplastic or cross-linkable polymer. The plastics material may be hot or cold polymerizable, and may optionally contain a polymerization catalyst. For example, the plastics material may comprise at least one polymer selected from: polypropylene (PP), polystyrene (PS), polyethylene (PE), polyamide (PA), such as PA6, polyethylene terephthalate (PET), polyacetal (POM), methacylate, urea-formaldehyde, melamine, and cyanoacrylate. This list is not exhaustive or limiting.

In exemplary embodiments, the applicator member may, for example, comprise a sintered material, and, for example, may be made out of a ceramic. The applicator member may, for example, be entirely made out of a sintered material. The applicator may be made with aid of a firing step. The applicator member may be porous, and may be made out of PE, PA or PET, for example; this list is not exhaustive or limiting. The inclusion of at least one cavity, if appropriate or desired, may reduce a quantity of material employed, and thus allow costs of the applicator member to be reduced.

In exemplary embodiments, the applicator member may be made by molding a plastics material, for example, by injection molding, with or without a cavity that is visible to the naked eye.

In exemplary embodiments, the applicator member may include magnetic particles, for example, ferrites or other magnetic oxides.

The particles may or may not be coated or colored.

In exemplary embodiments, a mean size of the particles contained in the support and/or in the applicator member may be in a range of about 0.1 μm (micrometer) to about 400 μm. For example, the mean size may be in a range of about 0.1 μm to about 150 μm. The support and/or applicator member may contain about 5% to about 90% by weight of particles. For example, the support and/or applicator may contain about 7% to about 75%, or even about 15% to about 70%, by weight of particles.

In embodiments in which the particles are coated particles, the particles may, for example, comprise a core made out of a first material and an envelope made out of a second material that differs from the first material. The envelope may extend at least partially around the core. The material of the core and/or envelope may be magnetic. The particles may, for example, have at least one of the following forms: spherical, elongate, or flattened.

In exemplary embodiments, the device may be configured so as to create a magnetic field that varies during application. Such variance in the magnetic field may be achieved, for example, when the applicator member is magnetic and movable.

In exemplary embodiments, the applicator member may be arranged to generate a magnetic field with an orientation that differs from an orientation of a magnetic field generated by the support.

Independently or in combination with the above, exemplary embodiments of the invention provide a device for packaging and applying a product, comprising: a magnetic support defining a housing; and an applicator member for applying a product contained in the housing of the support during application, the applicator member being rotatably movable in the housing of the support.

In exemplary embodiments, a space may be defined between the support and the applicator member through which product for application may flow. A magnetic field may exist in the space.

Independently or in combination with the above, exemplary embodiments of the invention provide a device for packaging and applying a product, comprising: a support defining a housing; and an applicator member for applying a product contained in the housing of the support during application, the applicator member being substantially non-deformable; the support including magnetic particles.

Independently or in combination with the above, exemplary embodiments of the invention provide a method of making a device for packaging and applying a product, the method comprising: providing an assembly comprising a support that defines a housing configured to pass a product and an applicator member retained in the housing of the support, the support including dispersed magnetic particles; and applying a magnetic field to the assembly to magnetize the magnetic particles of the support.

In exemplary embodiments, after the assembly has been magnetized, the assembly may be mounted on a receptacle that is already filled with product.

In exemplary embodiments, the applicator member may also include magnetic particles. In such embodiments, the support and the applicator member may be magnetized simultaneously.

In embodiments in which the applicator member is movable, for example, in rotation, relative to the support, for example, during application, orientations of magnetic fields generated by the particles of the support and of the applicator member, respectively, may change in different manners. The respective magnetic fields of the support and the applicator member may, for example, be alternately orientated in one direction and in an opposite direction. The magnetic fields may also be orientated perpendicularly to each other.

In exemplary embodiments, variable magnetic fields may, for example, be used to create novel effects on the product and/or a treated region, and/or may increase the efficacy of a treatment. The magnetic fields may, for example, act on micro-circulation of the blood.

Independently or in combination with the above, exemplary embodiments of the invention provide a method of applying a product, comprising: providing a device for packaging and applying a product, the device comprising: a support that defines a housing, the support including dispersed magnetic particles; and a product applicator member that is movable in rotation in the housing of the support during application; and causing the applicator member to rotate relative to the support to apply product.

In exemplary embodiments, the support may comprise at least one part molded as a single piece, for example, of plastics material, with magnetic particles dispersed in the molded part.

BRIEF DESCRIPTION OF THE DRAWINGS

The invention may be better understood from the following detailed description of non-limiting embodiments thereof, and on examining the accompanying drawings, in which.

DETAILED DESCRIPTION OF EMBODIMENTS

Figure 1:
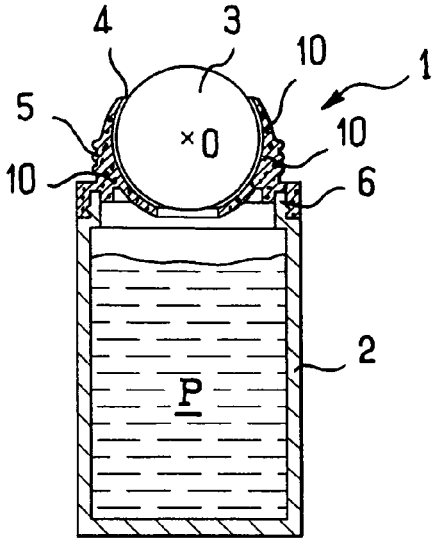
FIG. 1 is an axial cross-sectional view of an exemplary device.

FIG. 1 shows an exemplary device 1 for packaging and applying a cosmetic product P, for example, a makeup or a care product, that may comprise a receptacle 2 containing the product P and an applicator member 3 to distribute the product P.

Figure 14:
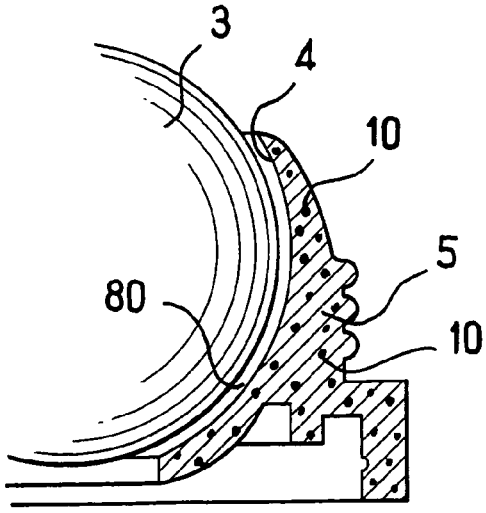
FIG. 14 shows a detail of FIG. 1.

The applicator member 3 may be received in a housing 4 defined by a support 4. The support 4 may be snap-fastened onto a neck 6 of the receptacle 2, for example, as shown. The housing 4 may pass product emanating from the receptacle 2. Product may move in a space 80 formed between the applicator member 3 and the support 5, for example, as shown diagrammatically in FIG. 14. The applicator member 3 may come into contact with the support 5 at certain regions.

The support 5, as shown, may be molded entirely from a single piece of plastics material, for example, but the present invention contemplates circumstance in which only a portion of the support 5 is molded from a single piece of plastics material. At least the portion of the support that is molded from a single piece of plastics material may include magnetic particles 10 dispersed in the plastics material. Thus, a magnetic field may exist in the space 80.

The particles 10 may be permanently magnetized or may be magnetizable. The particles 10 may, for example, be ferrites or other magnetic oxides.

In shown in the exemplary embodiment of FIG. 1, the applicator member 3 may be substantially spherical in form and may be substantially non-deformable during application. For example, the applicator member 3 may be made out of a sintered material, for example, a sintered thermoplastic material.

For example, a largest dimension of the applicator member may be in a range of about 5 mm to about 65 mm, or even in a range of about 7 mm to about 50 mm.

The applicator member 3 may be, for example, snap-fastened into the housing 4, thus being retained in the support 5 other than by magnetic attraction. As shown in the exemplary embodiment of FIG. 1, the applicator member 3 may be movable in rotation in the housing 4 about a center O thereof. Rotation of the applicator member 3 may contribute to causing product to pass through the housing 4 more easily. The invention contemplates a configuration in which the applicator member 3 is not rotatable, for example, being clamped in the housing 4.

Figure 2:
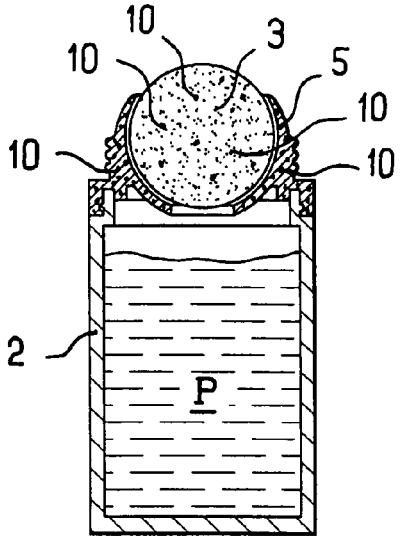
FIG. 2 is analogous to FIG. 1, showing another exemplary device.

As shown in the exemplary embodiment of FIG. 1, the applicator member 3 may be free of magnetic particles. However, the present invention contemplates an applicator member 3 that includes dispersed magnetic particles 10, as does the support 5, for example, as shown in FIG. 2.

Figure 13:
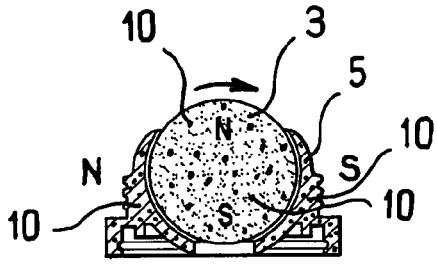
FIG. 13 illustrates modification in orientations of magnetic fields of the support and the applicator member during rotation of the member.

A magnetic field generated by the particles 10 of the applicator member 3 may change orientation, for example, relative to a magnetic field generated by the particles 10 of the support 5, when the applicator member 3 is caused to rotate relative to the support 5 to apply product to a surface to be treated, as illustrated in FIG. 13. Novel effects may thus be obtained on the product and/or on application thereof.

The particles 10 in the support 5 and/or in the applicator member 3 may or may not all be of a same nature. The support 5 and/or the applicator member 3 may, for example, include a mixture of particles 10 made out of different materials.

The particles 10 may have a variety of structures. For example, particles having a composite structure may be used, that is, particles comprising at least a core made out of a first material and at least partially surrounded by an envelope made out of a second material that differs from the first material. The material of the core and/or of the envelope may be magnetic. The particles may be substantially spherical or may have some other form. For example, the particles may be substantially elongate or flattened. The particles may also be of a structure having more than two layers, for example, a three-layer structure. The particles may also have an envelope that surrounds the core in part only. A mean particle size may, for example, be in a range of about 0.1 μm to about 400 μm, or even in a range of about 0.1 μm to about 150 μm.

The support 5 and/or the applicator member 3 may contain about 5% to about 90% by weight of particles 10, or about 7% to about 15%, or even about 15% to about 70%.

Figure 3:
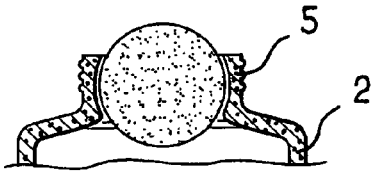
FIGS. 3 and 4 are diagrammatic axial cross-sectional views showing exemplary packaging and applicator devices.

As shown in the exemplary embodiments of FIGS. 1 and 2, the support 5 may be snap-fastened onto the neck of the receptacle 2. However, the present invention contemplates a case in which the support 5 is made as a single piece with the receptacle 2, for example, by molding, as shown in FIG. 3.

The housing 4 of the support 5 may or may not communicate directly with an inner space containing the product. As shown in the exemplary embodiments of FIGS. 1 to 3, communication may be direct. As shown in the exemplary embodiment of FIG. 4, communication may be indirect.

Figure 4:
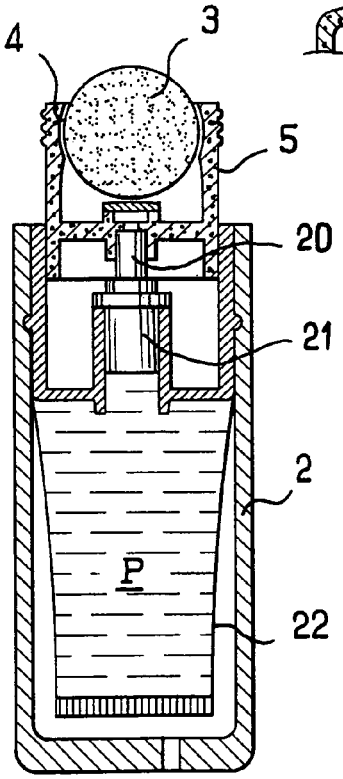

As shown in the exemplary embodiment of FIG. 4, the applicator member 3 and the support 5 may be secured to a rod 20 of a pump 21.

Product may be delivered by the pump 21, being taken from a flexible pouch 22, for example. To activate the pump 21, the support 5 may be pushed inward, the pump 21 being movable relative to the pouch 22 and the receptacle 2 that contains the pouch 22.

Figure 5:
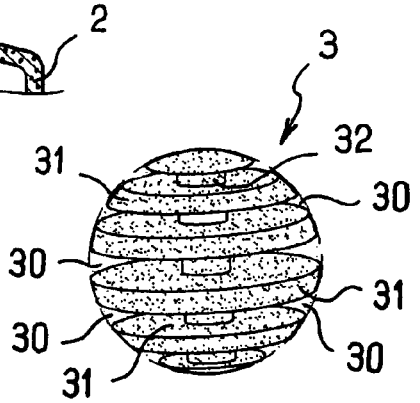
FIGS. 5 to 8 show various exemplary embodiments of applicator members.

The applicator member 3 may include cavities 30 that may, for example, be formed by annular grooves extending between vanes 31 that are disk-shaped and united by a central core 32, as shown in FIG. 5. If appropriate or desired, the cavities 30 may facilitate flow of product around the applicator member 3 in the housing 4.

The applicator member 3 may have cavities 30 made in other manners.

Figure 6:
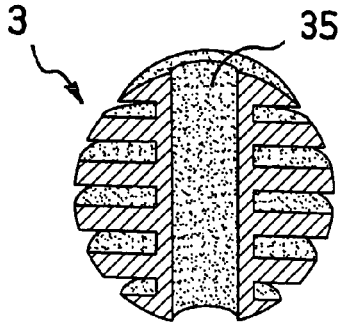

For example, FIG. 6 shows an exemplary applicator member 3 including a through passage 35 extending along a diameter, for example. The through passage 35 may, for example, be made in a core 32 of the applicator member 3, as shown in FIG. 5.

Figure 7:
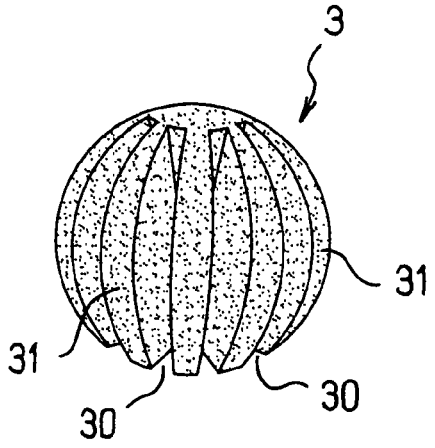

Alternatively or additionally, the applicator member 3 may comprise an envelope that is generally spherical in shape with cavities 30 defined by vanes 31 extending parallel to the meridians, for example, as shown in FIG. 7.

Figure 8:
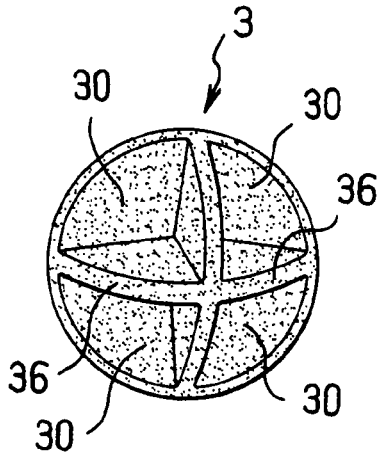

Alternatively or additionally, as shown in FIG. 8, the applicator member 3 may also have an envelope surface that is spherical in shape with cavities 30, each occupying about a quarter of a hemisphere, separated by walls 36 formed as quarter circles, for example.

The present invention contemplates configurations in which the applicator member 3 is substantially cylindrical, annular, ovoid, or groundnut-shaped in form.

In the exemplary embodiments described above, the applicator member 3 may be rotatably movable about a point. However, the present invention contemplates an applicator member that is rotatably movable about an axis of rotation in the housing of the support.

Figure 9:
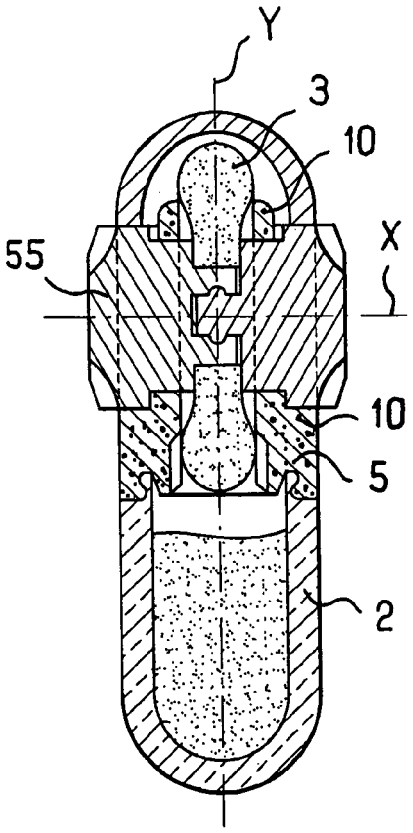
FIGS. 9 to 11 are diagrams showing other exemplary embodiments, in axial cross-section.
Figure 10:
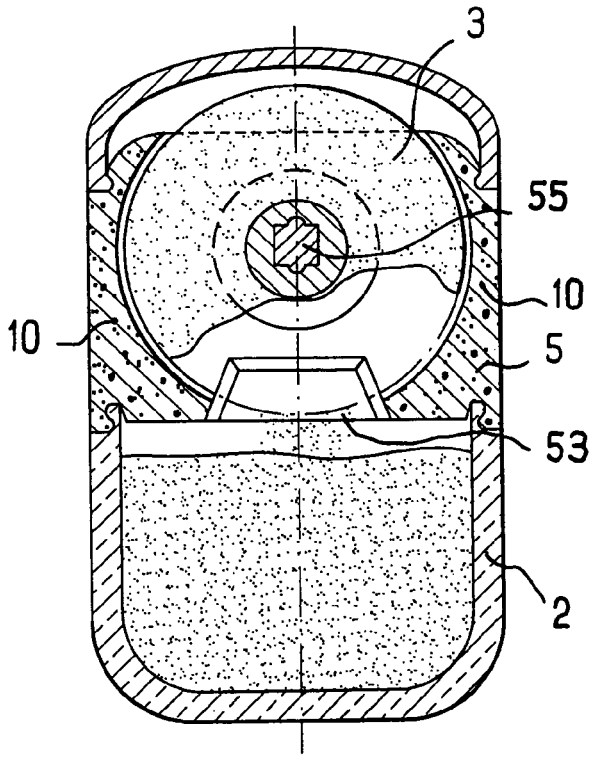

For example, FIGS. 9 and 10 show an exemplary device with a general structure as described in U.S. Pat. No. 5,401,113, which is incorporated herein by reference in its entirety.

Such a device may comprise a receptacle 2 and an applicator member 3 in the form of a disk that is rotatable about an axis of rotation X perpendicular to a longitudinal axis Y of the device. The rotatable disk 3 may be carried by a support 5 secured to the receptacle 2 and including dispersed magnetic particles 10. A lower region of the rotatable disk 3 may pass through a housing 53 of the support 5 opening into an interior of the receptacle 2. An upper region of the rotatable disk 3 may extend above the support 5 and may act to apply product.

The rotatable disk 3 may be integral with a hub 55 having axial ends that are accessible to a user from outside the receptacle 2, allowing the user to cause the rotatable disk 3 to rotate.

Figure 11:
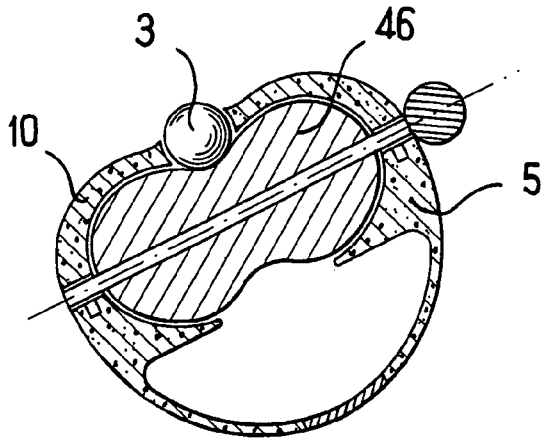

FIG. 11 shows an exemplary device with a general structure as described in U.S. Pat. No. 5,836,320, which is incorporated herein by reference in its entirety.

Product may be transferred by contact of a rotatable transfer member 46 on an applicator member 3.

Figure 12:
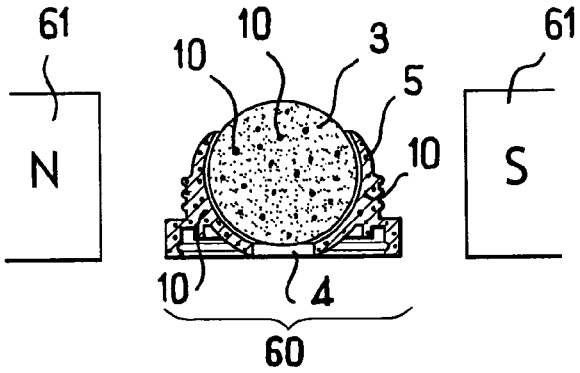
FIG. 12 is a diagram illustrating magnetization of an exemplary device.

The devices described in these patents may be magnetized by applying a magnetic field generated by a magnetic source 61, as shown diagrammatically in FIG. 12.

The various characteristics of the different embodiments described herein may be combined with one another.

For example, the applicator member of any such embodiments may be provided with or without magnetic particles and with or without a cavity.

Throughout the description, including the claims, the expression "comprising a" should be understood to be synonymous with "comprising at least one" unless otherwise indicated.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device for packaging and applying a product, comprising:

a receptacle containing the product;

a support defining a housing to pass product emanating from the receptacle, the support comprising dispersed magnetic particles distributed throughout a molded thermoplastic material; and an applicator member retained in the housing, wherein the applicator member is rotatably movable in the housing.

2. A device according to claim 1, wherein the support comprises a part molded as a single piece with dispersed magnetic particles.

3. A device according to claim 1, wherein the applicator member is rotatably movable about a point in the housing.

4. A device according to claim 1, wherein the applicator member is rotatably movable about an axis of rotation in the housing.

5. A device according to claim 4, wherein the axis of rotation is perpendicular to a longitudinal axis of the device.

6. A device according to claim 1, wherein the applicator member comprise one of a substantially spherical, cylindrical, ovoid, discoid, annular, or groundnut-shaped form.

7. A device according to claim 1, wherein the applicator member comprises a body of revolution.

8. A device according to claim 1, wherein the applicator member comprises at least one cavity that is visible to the naked eye.

9. A device according to claim 1, wherein the applicator member comprises at least one vane.

10. A device according to claim 1, wherein the applicator member comprises at least one through-passage.

11. A device according to claim 1, wherein a largest dimension of the applicator member is in a range of about 5 mm to about 65 mm.

12. A device according to claim 1, wherein a largest dimension of the applicator member is in a range of about 7 mm to about 50 mm.

13. A device according to claim 1, wherein the applicator member is substantially non-deformable during use.

14. A device according to claim 1, wherein the applicator member comprises a material that is deformable on application.

15. A device according to claim 1, wherein the applicator member comprises a material that is elastically deformable.

16. A device according to claim 1, further comprising a member that transfers product to the applicator member.

17. A device according to claim 1, wherein the support is fixed on a rod of a pump provided in the receptacle.

18. A device according to claim 1, wherein the support is made as a single piece with the receptacle containing the product.

19. A device according to claim 1, wherein the applicator member comprises magnetic particles.

20. A device according to claim 1, wherein at least one of the support and the applicator member contains about 5% to about 90% by weight of magnetic particles.

21. A device according to claim 1, wherein at least one of the support and the applicator member contains about 7% to about 75% by weight of magnetic particles.

22. A device according to claim 1, wherein at least one of the support and the applicator member contains about 15% to about 70% by weight of magnetic particles.

23. A device according to claim 22, wherein the support comprises a material that is more flexible than a material comprising the applicator member.

24. A device according to claim 1, wherein the device is configured to create a variable magnetic field during application.

25. A device according to claim 1, wherein the magnetic particles are coated.

26. A device according to claim 1, wherein the magnetic particles are colored.

27. A device according to claim 1, wherein the support is arranged to deform during application.

28. A device according to claim 1, wherein the applicator member generates a magnetic field with an orientation that differs from an orientation of a magnetic field generated by the support.

29. A device according to claim 1, further comprising a space formed between the applicator member and the support with a magnetic field present in the space, the space being arranged to allow product to flow therein.

30. A method of making a device for packaging and applying a product, the method comprising:

providing an assembly comprising a support that defines a housing configured to pass a product, and an applicator member retained in the housing of the support, wherein the applicator member is rotatably movable in the housing, the support comprising dispersed magnetic particles distributed throughout a molded thermoplastic material; and applying a magnetic field to the assembly to magnetize the magnetic particles of at least one of the support and the applicator member when the applicator member comprises magnetic particles.

31. A method according to claim 30, wherein, after the magnetic particles are magnetized, said assembly is mounted on a receptacle containing product.

32. A method of applying a product, comprising:

providing a device for packaging and applying a product, the device comprising:

a support defining a housing configured to pass the product, the support comprising dispersed magnetic particles distributed throughout a molded thermoplastic material; and a product applicator member retained in the housing of the support during application, wherein the applicator member is rotatably movable in the housing; and causing the applicator member to rotate relative to the support to apply the product.

* * * * *